US009153395B2

(12) United States Patent
Chu

(10) Patent No.: US 9,153,395 B2
(45) Date of Patent: Oct. 6, 2015

(54) SWITCH STRUCTURE WITH DISPLAY AND PLAYBACK FUNCTIONS

(71) Applicant: Ching-Hsiung Chu, Taipei (TW)

(72) Inventor: Ching-Hsiung Chu, Taipei (TW)

( * ) Notice: Subject to any disclaimer, the term of this patent is extended or adjusted under 35 U.S.C. 154(b) by 139 days.

(21) Appl. No.: 14/080,816

(22) Filed: Nov. 15, 2013

(65) Prior Publication Data

US 2015/0136577 A1 May 21, 2015

(51) Int. Cl.

| | |
|---|---|
| ***H01H 9/18*** | (2006.01) |
| ***H01H 13/14*** | (2006.01) |
| ***H01H 13/10*** | (2006.01) |
| ***H01H 13/02*** | (2006.01) |

(52) U.S. Cl.

CPC ..... *H01H 13/10* (2013.01); *H01H 13/023* (2013.01); *H01H 13/14* (2013.01); *H01H 2207/004* (2013.01); *H01H 2207/04* (2013.01); *H01H 2219/002* (2013.01); *H01H 2227/002* (2013.01)

(58) Field of Classification Search

CPC ..... H01H 13/83; H01H 9/181; H01H 13/14; H01H 13/10; H01H 13/23

USPC ..... 200/312–317

See application file for complete search history.

(56) References Cited

U.S. PATENT DOCUMENTS

| | | | | |
|---|---|---|---|---|
| 4,987,279 | A * | 1/1991 | Hirose et al. | 200/314 |
| 5,072,085 | A * | 12/1991 | Shinohara et al. | 200/314 |
| 5,278,362 | A * | 1/1994 | Ohashi | 200/5 A |
| 6,310,308 | B1 * | 10/2001 | Watson et al. | 200/520 |
| 6,570,107 | B1 * | 5/2003 | Nishimoto et al. | 200/6 R |
| 7,554,047 | B2 * | 6/2009 | Verdu et al. | 200/314 |
| 7,943,875 | B2 * | 5/2011 | Chu | 200/293 |
| 8,558,130 | B2 * | 10/2013 | Martinez et al. | 200/314 |
| 2008/0073190 | A1 * | 3/2008 | Cove | 200/314 |
| 2009/0107817 | A1 * | 4/2009 | Onuki et al. | 200/314 |
| 2011/0048909 | A1 * | 3/2011 | Clark et al. | 200/330 |
| 2011/0127149 | A1 * | 6/2011 | Sun | 200/314 |
| 2011/0315533 | A1 * | 12/2011 | Chu | 200/345 |
| 2012/0061227 | A1 * | 3/2012 | Chu | 200/520 |
| 2012/0061228 | A1 * | 3/2012 | Chu | 200/520 |
| 2015/0096876 | A1 * | 4/2015 | Mittleman et al. | 200/341 |

* cited by examiner

*Primary Examiner* — Renee Luebke
*Assistant Examiner* — Ahmed Saeed

(57) ABSTRACT

A switch structure with display and playback functions includes a base, a circuit board, a holder, a display screen, and a cover. The circuit board is received in the base and has an electrical connection region. A supporting member and a flexible flat cable are provided below the holder. An elastic supporting element in the supporting member corresponds in position to the electrical connection region and is provided with an electrical connector. The display screen is provided on the holder and is electrically connected to the circuit board by the flexible flat cable. The cover covers the holder and the display screen. When the cover is pressed downward, thereby compressing the elastic supporting element, the electrical connector is contacted with, and closes the circuit of, the electrical connection region to connect the display screen to the circuit board. The switch structure features a small internal space and small thickness.

8 Claims, 9 Drawing Sheets

SWITCH STRUCTURE WITH DISPLAY AND PLAYBACK FUNCTIONS

BACKGROUND OF THE INVENTION

1. Technical Field

The present invention relates to the structural design of press-button switches and, more particularly, to a switch structure having display and playback functions.

2. Description of Related Art

An improved electrical connection structure for use in a press-button switch is now commercially available. Basically, a flexible flat cable is provided in a base and is connected to the circuit board supported on a movable support. When the switch housing is pressed, a frame therein and the movable support are moved downward such that the electrical contacts at the bottom of the movable support are in contact with the conductive terminals in the base to provide electrical connection. The flexible flat cable, which changes its physical configuration with the upward and downward movement of the frame and the movable support, does not require additional force to be applied when pressing the switch housing. Once the movable support is provided on the base, the ridges on the four inner walls of the bottom receiving space of the movable support are respectively engaged with the position-limiting blocks in the guide grooves in the four outer lateral sides of the base. The guide grooves serve to guide the ridges of the movable support, allowing the movable support to move smoothly up and down. The conductive terminals and the flexible flat cable are inserted in the through holes and through slot in the base respectively and can be directly detached from the base to facilitate replacement and maintenance.

While the foregoing product effectively reduces the pressing force required, enhances the smoothness of movement of the entire mechanism, and enables easy maintenance and replacement, the internal structure for electrically connecting the circuit board to the LED screen—implemented by contact between the electrical contacts at the bottom of the movable support and the conductive terminals in the base—has the following drawbacks, despite the fact that the aforesaid design allows unhindered upward and downward movement of the movable support and that the electrical contacts have the incidental shock-absorbing and impact-cushioning effects. First, the conductive terminals provided in the base hugely complicate the internal structure of the press-button switch. Second, the distance between the base and the movable support increases the thickness of the switch, which goes against the current trend of making smaller and more compact switches.

BRIEF SUMMARY OF THE INVENTION

A switch structure with display and playback functions is configured to be mounted on an external circuit board on an external fixing frame and includes a base, a circuit board, a holder, a display screen, and a cover. The base has a receiving space. The bottom of the base is provided with a plurality of through holes on each of two opposite lateral sides. The circuit board is received in the receiving space and is peripherally provided with a plurality of pins which correspond respectively in position to the through holes and which are to be connected to the external circuit board. The circuit board is provided with an electrical connection region on the surface. A supporting member and a flexible flat cable are provided below the holder. The supporting member has a groove. The groove is provided with an elastic supporting element corresponding in position to the electrical connection region. The elastic supporting element has an electrical connector received therein. The display screen is provided on the holder and is electrically connected to the circuit board by the flexible flat cable. The cover covers the holder and the display screen. A suitable portion of the cover is light-permeable such that the display screen is visible from outside the cover.

Preferably, a portion or all of the cover is transparent or translucent; the holder is provided with a projection on each of two opposite lateral sides so that the holder can be fixedly engaged in the cover; the base is provided with at least one engaging portion on each of two opposite outer lateral sides; the cover is provided with at least one engaging groove on each of two opposite outer lateral sides, wherein the engaging grooves correspond in position to and are fixedly engaged with the engaging portions respectively; the elastic supporting element is made of a flexible non-metal material and is capable of absorbing shock and cushioning impact; the electrical connector is made of graphite, which is electrically conductive; the electrical connection region is composed of two spaced-apart semicircular parts; and the two semicircular parts are electrically connected when the electrical connector is in contact with them.

In the foregoing switch structure with display and playback functions, the electrical connector is contacted with the electrical connection region when the cover is pressed downward and compresses the elastic supporting element with the holder. Upon such contact, the electrical connection region is turned from its original open-circuit state into a closed-circuit state to close the circuit between the display screen and the circuit board, allowing the display screen to display the prompt information transmitted by the circuit board. As the electrical connection region of the present invention is directly provided on the surface of the circuit board, there is no need to provide the base with additional conductive terminals, meaning the internal space of the switch can be greatly reduced. Therefore, the present invention not only advantageously lowers the pressing force required, increases the smoothness of motion of the entire mechanism, and allows easy replacement and maintenance, as can the prior art device described above, but also has a smaller switch thickness.

BRIEF DESCRIPTION OF THE SEVERAL VIEWS OF THE DRAWINGS

The objects and advantages of the present invention will be best understood by referring to the following detailed description of some illustrative embodiments and the accompanying drawings, in which.

DETAILED DESCRIPTION OF THE INVENTION

Figure 1:
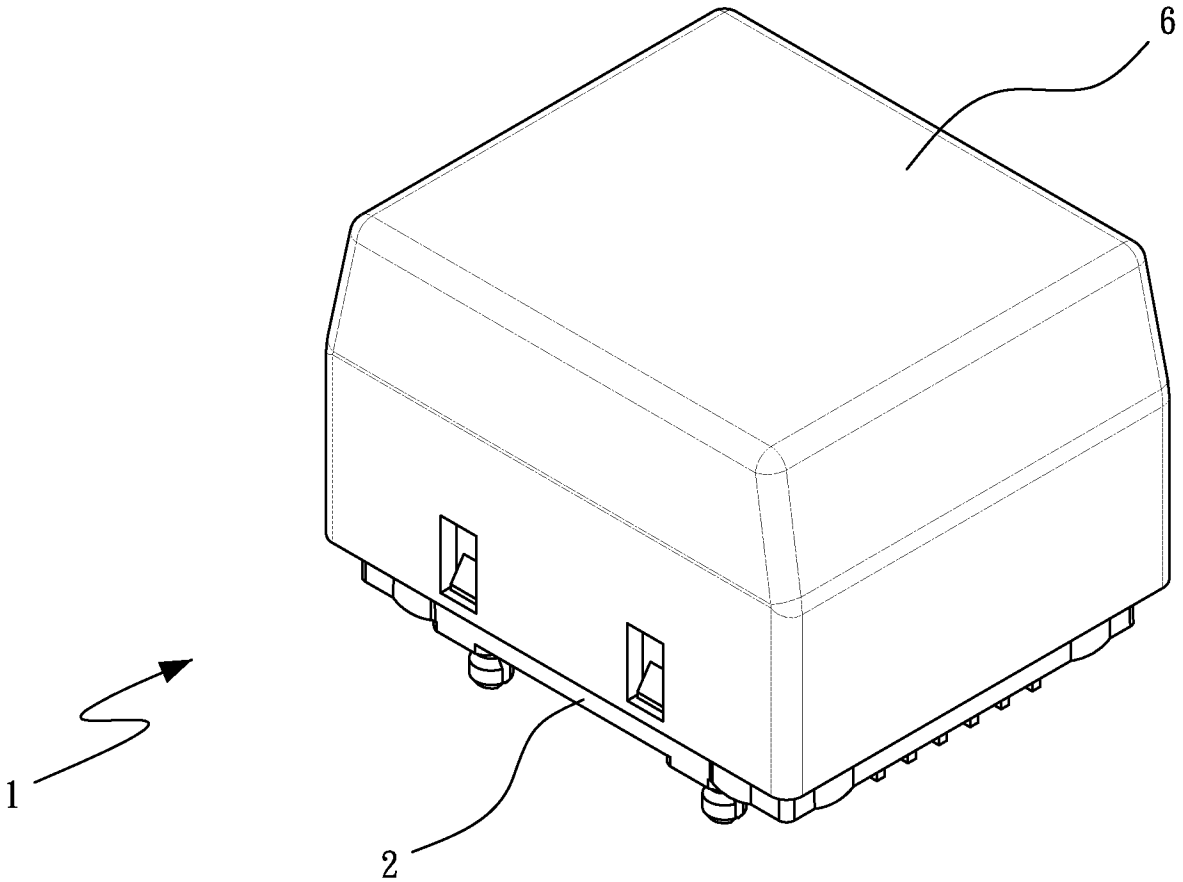
FIG. 1 is an assembled perspective view of the present invention.
Figure 2:
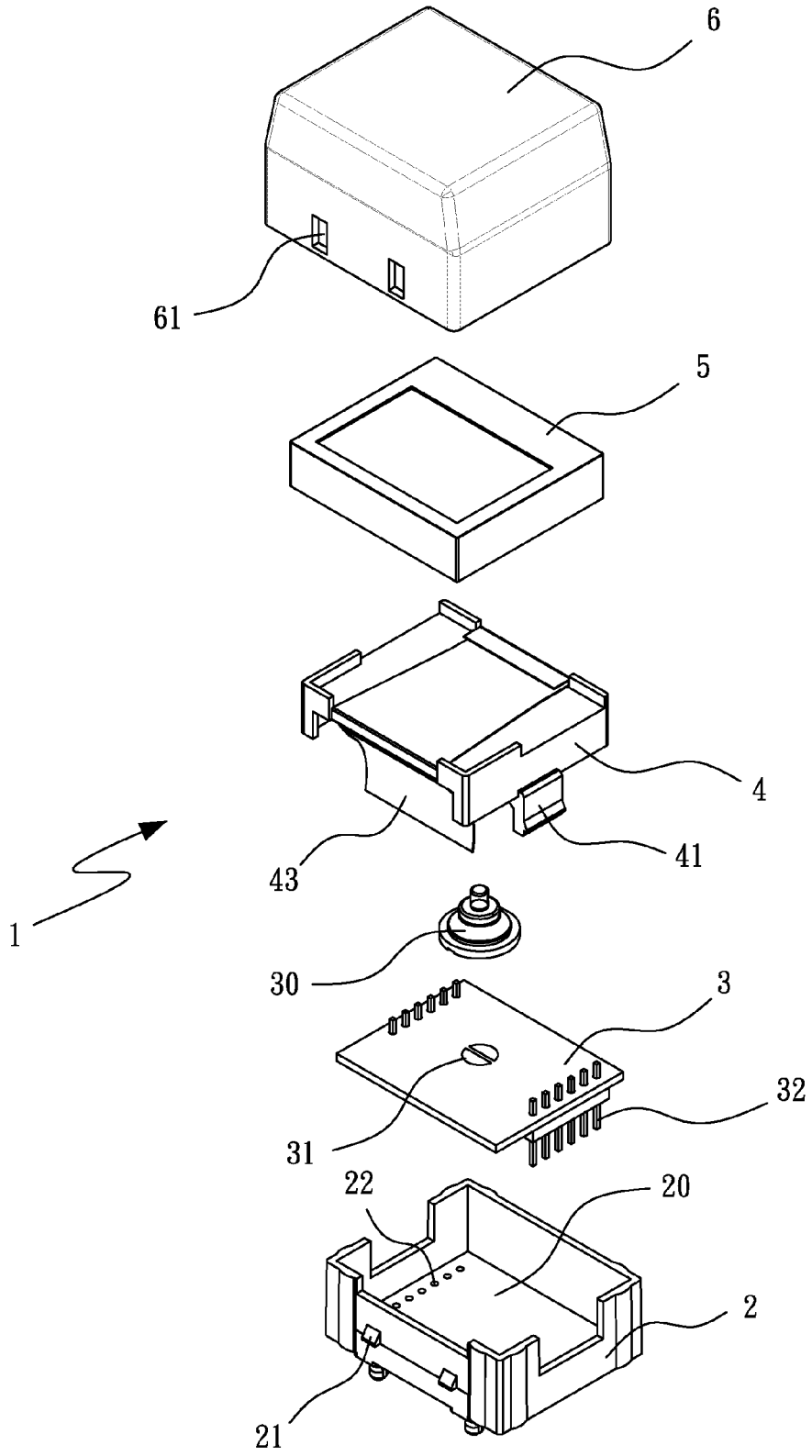
FIG. 2 is an exploded perspective view of the present invention.
Figure 3:
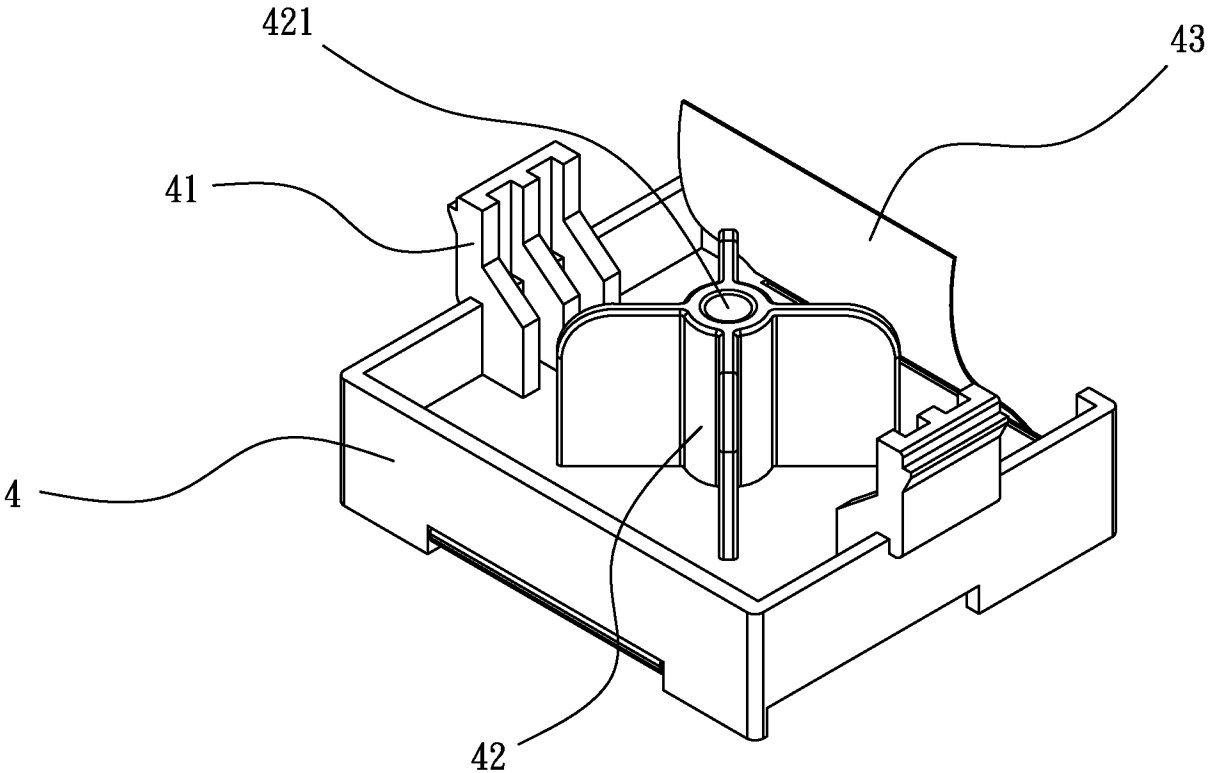
FIG. 3 is a perspective view of a holder in the present invention.
Figure 4:
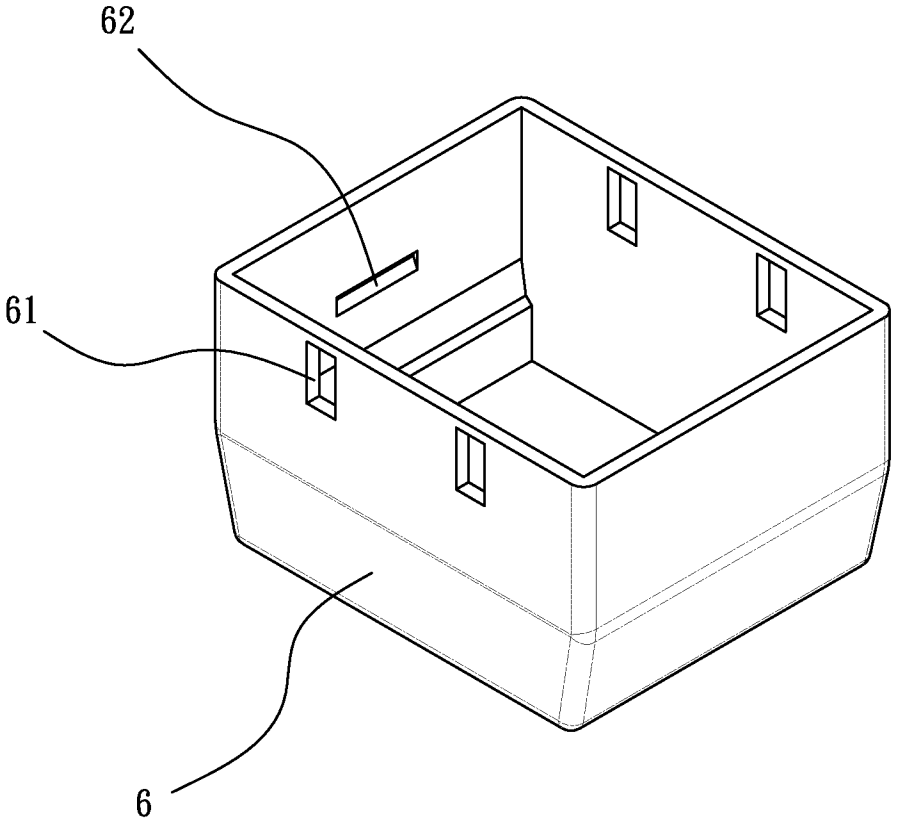
FIG. 4 is a perspective view of a cover in the present invention.
Figure 5:
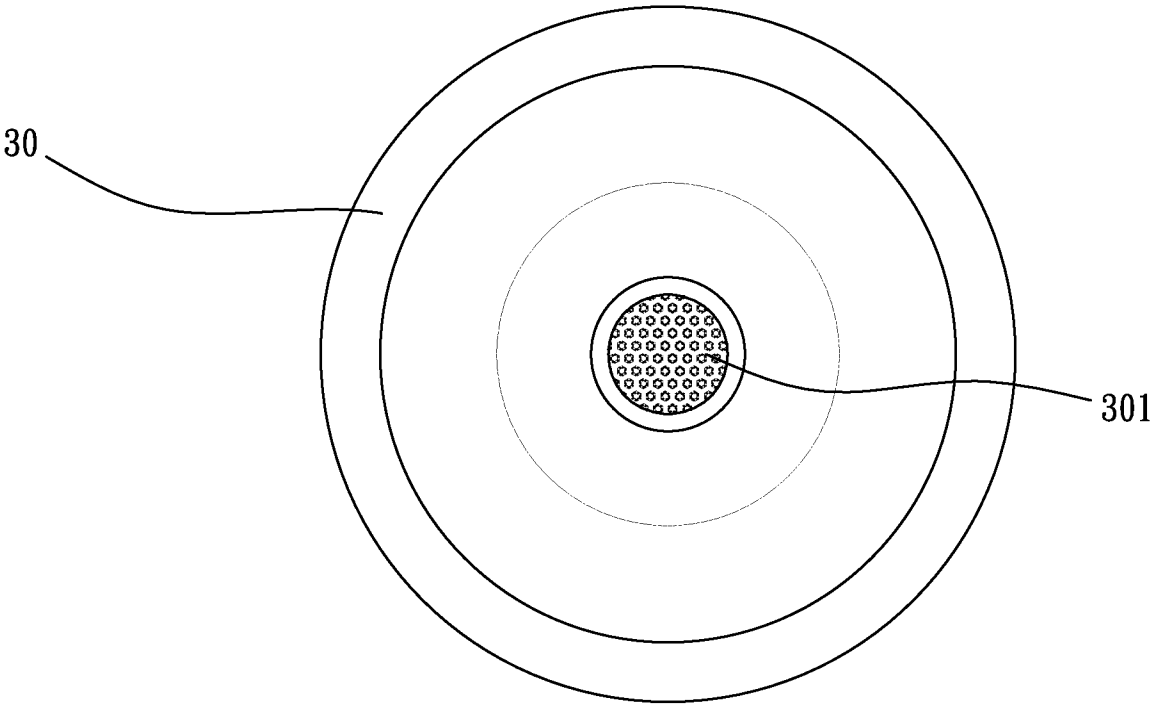
FIG. 5 is a top view of an elastic supporting element in the present invention.

Referring to FIG. 1 to FIG. 5, a switch structure 1 with display and playback functions is designed to be mounted on a circuit board (not shown) on a fixing frame (not shown) and has the following essential components arranged from bottom to top: a base 2, a circuit board 3, a holder 4, a display screen 5, and a cover 6. The base 2 has a receiving space 20 and is provided with at least one engaging portion 21 on each of two opposite outer lateral sides. The bottom of the base 2 is provided with a plurality of through holes 22 on each of two opposite lateral sides. The circuit board 3 is received in the receiving space 20 and is peripherally provided with pins 32 which correspond in position to the through holes 22 respectively. The pins 32 are to be connected to the circuit board on the fixing frame. An electrical connection region 31 is provided on a surface of the circuit board 3 and is composed of two spaced-apart semicircular parts such that the electrical connection region 31 forms an open circuit.

A supporting member 42 and a flexible flat cable 43 are provided below the holder 4, and a projection 41 is provided on each of two opposite lateral sides of the holder 4. The supporting member 42 has a groove 421. The groove 421 is provided with an elastic supporting element 30 corresponding in position to the electrical connection region 31. The elastic supporting element 30, which is made of a flexible non-metal material, serves shock-absorbing and impact-cushioning purposes and has an electrical connector 301 received therein. The electrical connector 301 is made of graphite, which is electrically conductive. The electrical connector 301 can be brought into contact with the two semicircular parts to electrically connect the two semicircular parts. The display screen 5 is provided on the holder 4 and is electrically connected to the circuit board 3 by the flexible flat cable 43. The cover 6 covers the holder 4 and the display screen 5 and may be completely or partially light-permeable so that the display screen 5 can be viewed from outside the cover 6. As used herein, the term "light-permeable" means being transparent or translucent. The cover 6 is provided with at least one engaging groove 61, 62 on each of two opposite outer lateral sides. The engaging grooves 61, 62 correspond in position to and are fixedly engaged with the engaging portions 21 respectively. The holder 4 is fixedly engaged in the cover 6 by means of the projections 41.

The switch structure 1 with display and playback functions is so designed that the cover 6, when pressed downward by an external force, drives the holder 4 to compress the elastic supporting element 30 against the circuit board 3. With the elastic supporting element 30 compressed between the holder 4 and the circuit board 3, the electrical connector 301 is in contact with the two spaced-apart semicircular parts of the electrical connection region 31 on the surface of the circuit board 3. The two semicircular parts are therefore turned from the original open-circuit state into a closed-circuit state, closing the circuit between the display screen 5 and the circuit board 3, so as for the display screen 5 to display the prompt information transmitted from the circuit board 3.

Figure 6:
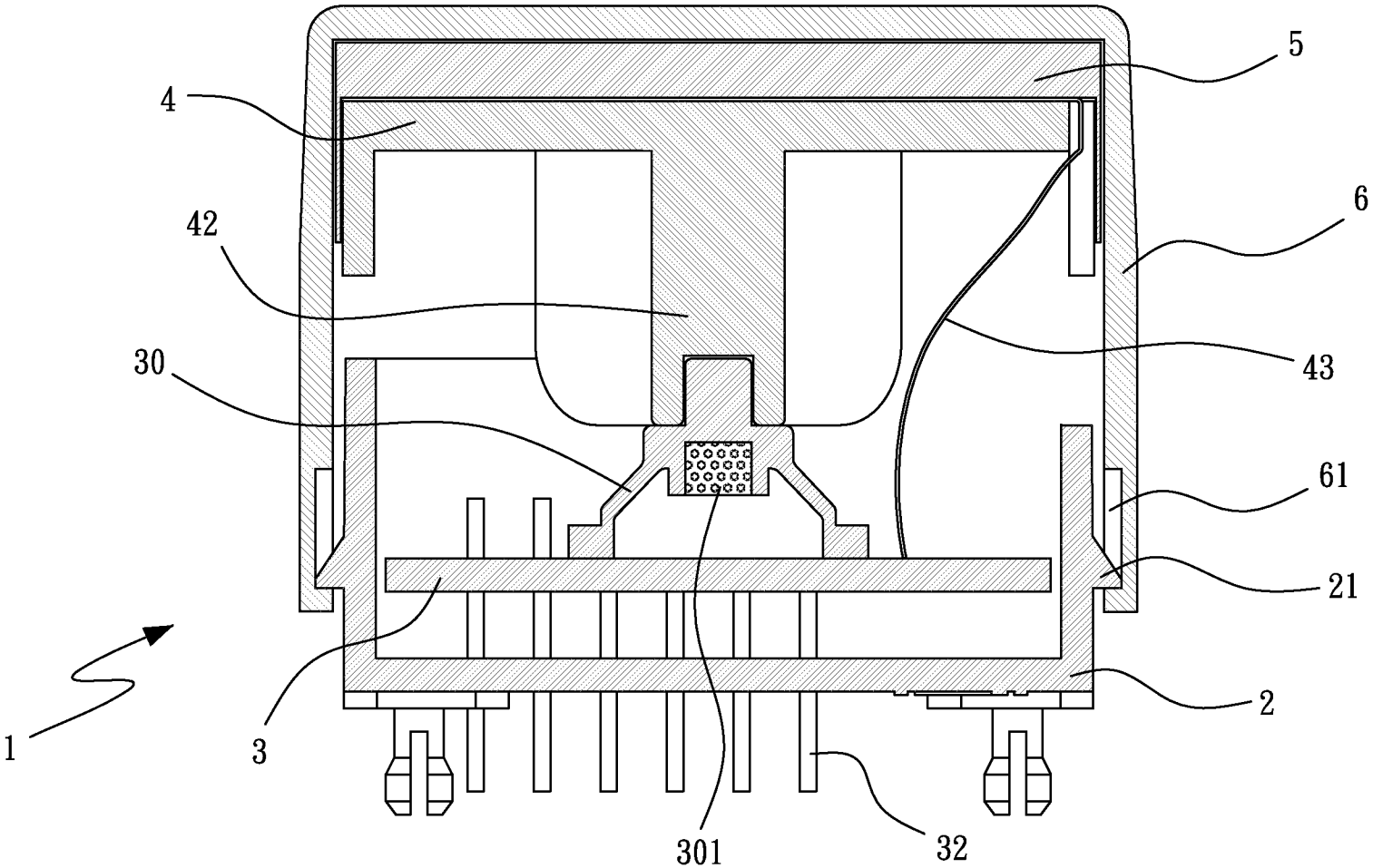
FIG. 6 is a sectional view showing an embodiment of the present invention in a normal state.
Figure 7:
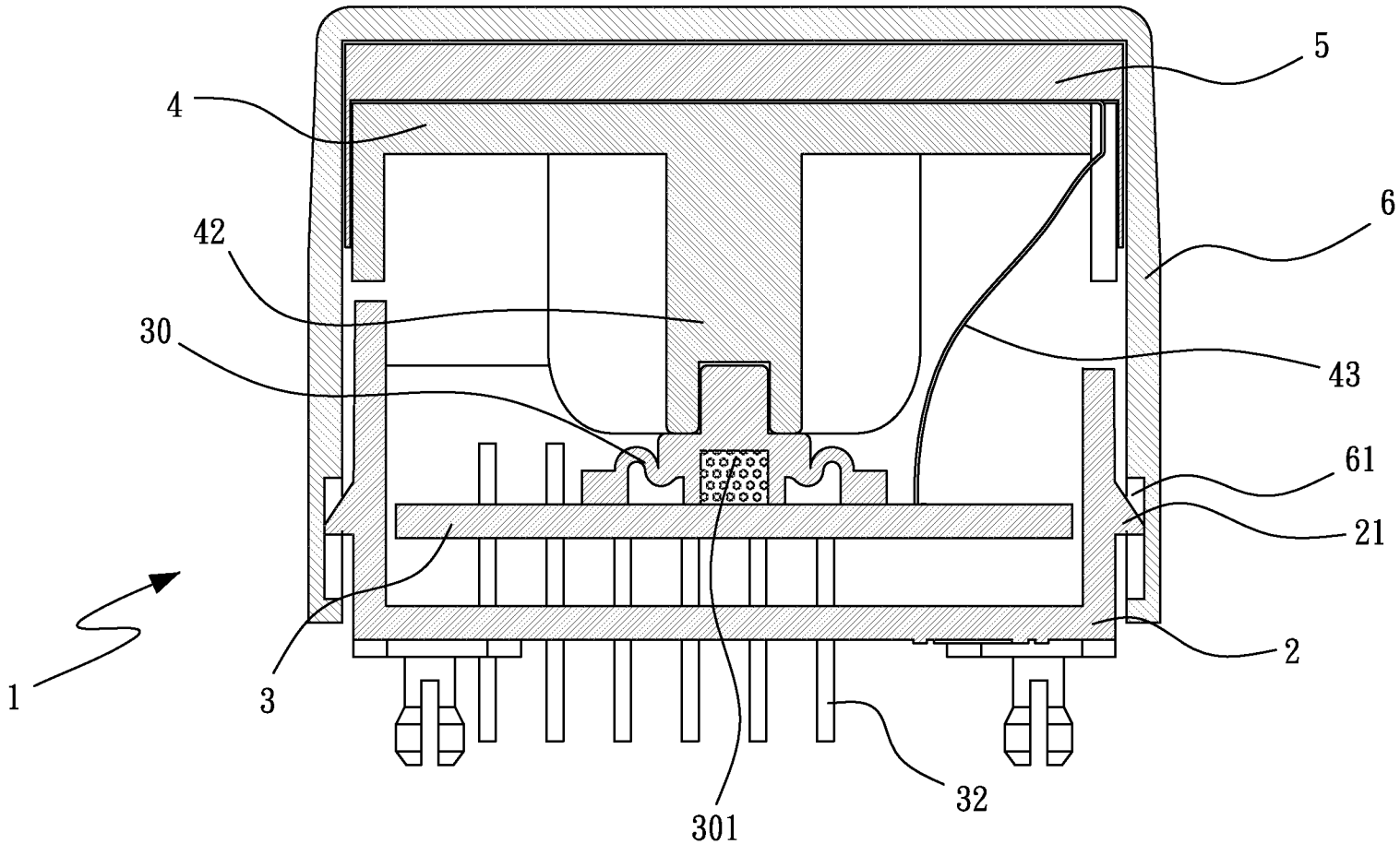
FIG. 7 is a sectional view showing the embodiment of FIG. 6 in a pressed state.
Figure 8:
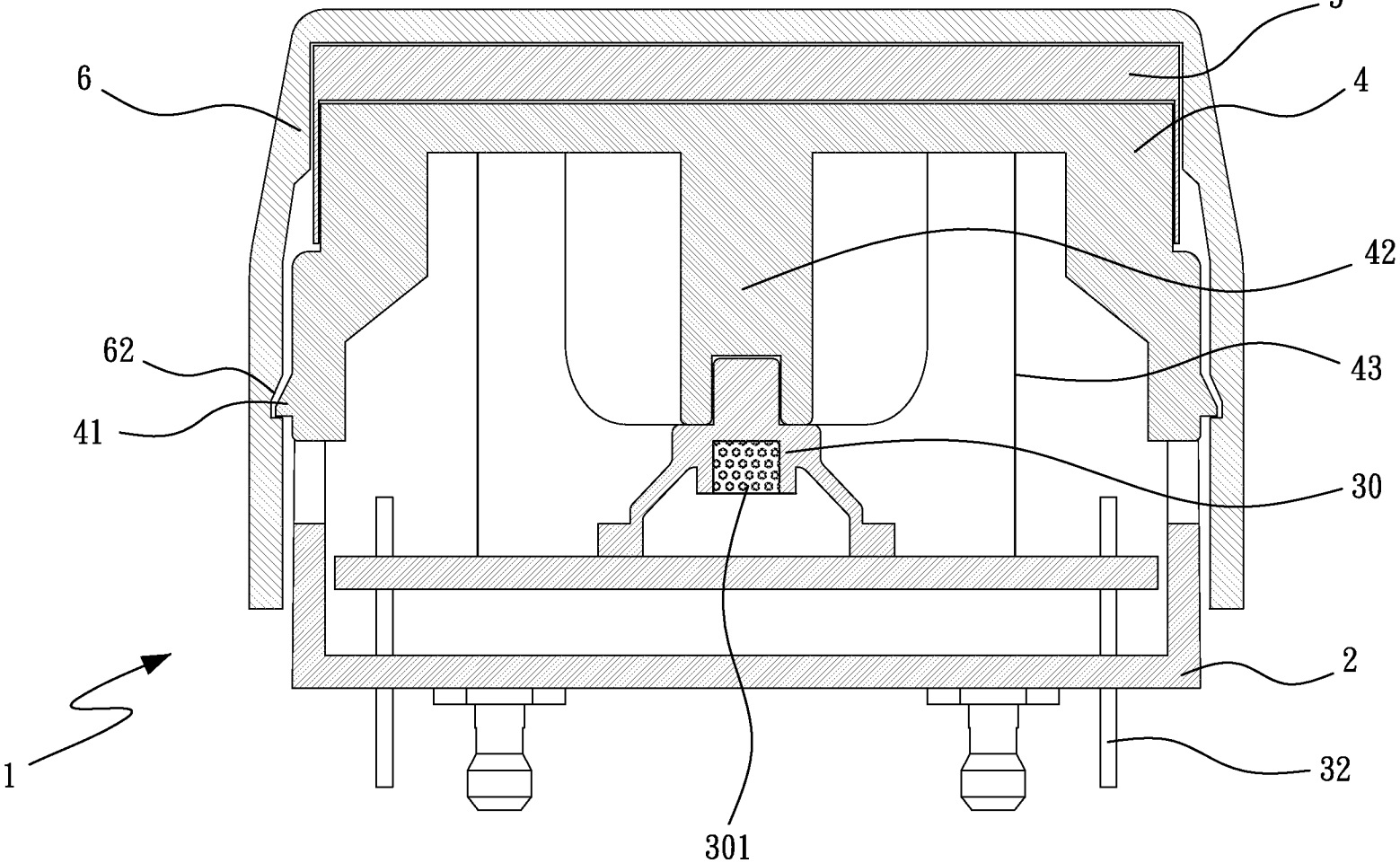
FIG. 8 is a sectional view showing another embodiment of the present invention in a normal state.

Reference is now made to FIG. 1 through FIG. 9, particularly FIG. 6 and FIG. 8. As the elastic supporting element 30 of the present invention is made of a flexible non-metal material, it assumes a supporting configuration when not compressed by an external force. In this state, the elastic supporting element 30 serves to absorb shock and cushion impact while the graphite electrical connector 301 is not in contact with the electrical connection region 31 on the circuit board 3. The circuit between the display screen 5 and the circuit board 3 is open, meaning the circuit board 3 is not electrically connected to and therefore cannot transmit any prompt information to the display screen 3.

Figure 9:
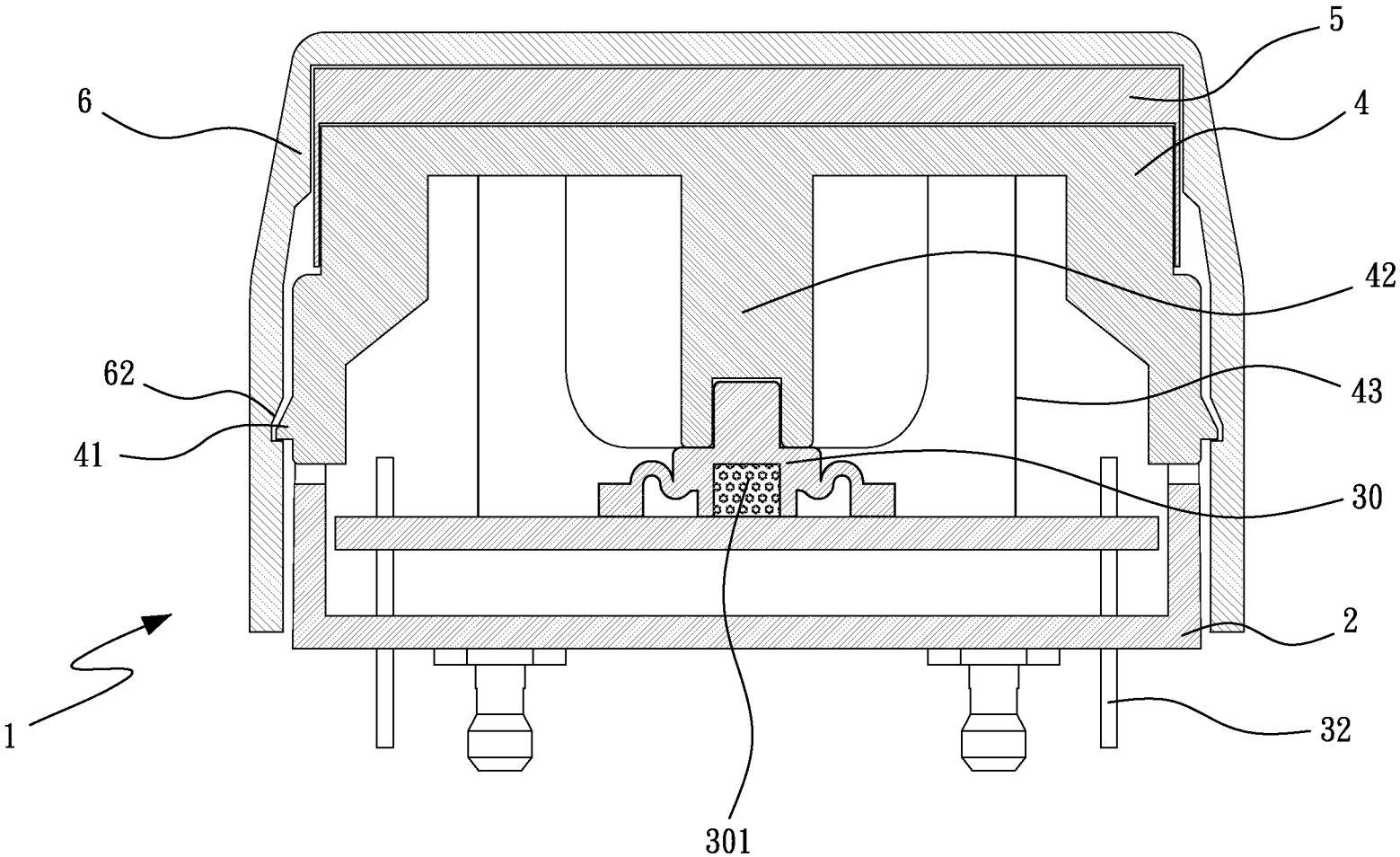
FIG. 9 is a sectional view showing the embodiment of FIG. 8 in a pressed state.

As shown in FIG. 7 and FIG. 9, once the cover 6 of the present invention is pressed downward by an external force, it drives the holder 4 to compress the elastic supporting element 30 against the circuit board 3 such that the elastic supporting element 30 is deformed, i.e., compressed between the holder 4 and the circuit board 3. As a result, the graphite electrical connector 301 is brought into contact with the electrical connection region 31 on the circuit board 3. Due to the electrical conductivity of graphite, the electrical connector 301, now in contact with the two semicircular parts of the electrical connection region 31, electrically connects the two semicircular parts and thereby closes the circuit between the display screen 5 and the circuit board 3. With the circuit board 3 electrically connected to the display screen 5, the display screen 5 can display the prompt information transmitted by the circuit board 3.

What is claimed is:

1. A switch structure with display and playback functions, to be mounted on an external circuit board on an external fixing frame, the switch structure comprising:

a base having a receiving space and a bottom, the bottom having two opposite lateral sides each provided with a plurality of through holes;

a circuit board received in the receiving space, the circuit board being peripherally provided with a plurality of pins corresponding in position to the through holes respectively in order for the pins to connect to the external circuit board on the external fixing frame, the circuit board having a surface provided with an electrical connection region;

a holder below which are provided a supporting member and a flexible flat cable, the supporting member having a groove, the groove being provided with an elastic supporting element corresponding in position to the electrical connection region, the elastic supporting element receiving an electrical connector therein;

a display screen provided on the holder and electrically connected to the circuit board by the flexible flat cable; and a cover covering the holder and the display screen, the cover being completely or partially light-permeable such that the display screen is visible from outside the cover;

the switch structure being characterized in that: the electrical connection region is directly provided on the surface of the circuit board; and when the cover is pressed downward and thus drives the holder to compress the elastic supporting element, the electrical connector is brought into contact with the electrical connection region, turning the electrical connection region from an original open-circuit state into a closed-circuit state, such that the display screen is electrically connected to the circuit board, the switch structure therefore allowing an internal space thereof and a thickness thereof to be reduced.

2. The switch structure of claim 1, wherein a portion or all of the cover is transparent or translucent.

3. The switch structure of claim 1, wherein the holder has two opposite lateral sides each provided with a projection, and the holder is fixedly engaged in the cover via the projections.

4. The switch structure of claim 1, wherein the base has two opposite outer lateral sides each provided with at least one engaging portion.

5. The switch structure of claim 4, wherein the cover has two opposite outer lateral sides each provided with at least one engaging groove, the engaging grooves corresponding in position to and fixedly engaging with the engaging portions respectively.

6. The switch structure of claim 1, wherein the elastic supporting element is made of a flexible non-metal material and capable of absorbing shock and cushioning impact.

7. The switch structure of claim 1, wherein the electrical connector is made of graphite, which is electrically conductive.

8. The switch structure of claim 1, wherein the electrical connection region is composed of two spaced-apart semicircular parts.

* * * * *